United States Patent [19]

Nakai et al.

[11] Patent Number: 4,989,799

[45] Date of Patent: Feb. 5, 1991

[54] APPARATUS FOR WINDING A MULTIFILAMENT WITH FLAT SHAPE AND BROAD WIDTH

[75] Inventors: Shoji Nakai, Ibaraki; Shuichiro Imai, Toyonaka, both of Japan

[73] Assignee: Kamitsu Seisakusho Ltd., Hyogo, Japan

[21] Appl. No.: 452,610

[22] Filed: Dec. 18, 1989

[30] Foreign Application Priority Data

Dec. 26, 1988 [JP] Japan ..... 63-326182
May 1, 1989 [JP] Japan ..... 1-112648
Nov. 13, 1989 [JP] Japan ..... 1-130975[U]

[51] Int. Cl.[5] ..... B65H 54/00; B65H 57/16
[52] U.S. Cl. ..... 242/042; 242/157 R
[58] Field of Search ..... 242/42, 7.21, 157 R

[56] References Cited

U.S. PATENT DOCUMENTS 1,966,507 7/1934 Langstreth ..... 242/42
2,092,811 9/1937 Moncrieff et al. ..... 242/42
2,623,701 12/1952 Nuttle ..... 242/42
3,363,849 1/1968 McLarty ..... 242/7.21
3,438,587 4/1969 Jackson, Jr. ..... 242/42
3,977,614 8/1976 Hardwick ..... 242/7.21 X
4,130,248 12/1978 Hendrix et al. ..... 242/42 X
4,154,410 5/1979 Haehnel et al. ..... 242/42 X
4,488,686 12/1984 Reese ..... 242/42 X

*Primary Examiner*—Stanley N. Gilreath
*Attorney, Agent, or Firm*—Burgess, Ryan & Wayne

[57] ABSTRACT

An apparatus for winding a multifilament in a flat shape with a broad width, including a self-rotatable mandrel and a yarn guiding device comprising a pair of conical rotatable roll, a generatrix of each being arranged in parallel to the other, and having a space in a direction perpendicular to a traverse direction of the multifilament, a collecting means arranged downstream of the pair of guide roll and collecting the multifilament along the traverse direction of the multifilament, and a spreading means downstream of the collecting means and spreading the multifilament along the traverse direction of the multifilament.

The multifilament, such as a carbon fiber, can be wound in uniformly spread state on the mandrel by using the apparatus in accordance with the present invention.

7 Claims, 4 Drawing Sheets

APPARATUS FOR WINDING A MULTIFILAMENT WITH FLAT SHAPE AND BROAD WIDTH

BACKGROUND OF THE INVENTION

1. Field of the Invention

The present invention relates to an apparatus of winding a multifilament which, when delivered in a collected state to a mandrel, has a flat shape and a broad width.

2. Description of the Related Art

Recently, high function fibers such as a carbon fiber, a ceramic fiber, Kevler ®, or the like have been used as fibers capable of improving the strength of a structure. To improve the qualities of the structure obtained, and the production efficiency thereof, the fiber must be wound in a thin and flat shape with a broad width, and therefore, a traverse guide having a specific shape is used, as shown in Japanese Examined Utility Model Publication (Kokoku) No. 46-2114 and Japanese Examined Patent Publication (Kokoku) No. 45-24696.

The multifilament, however, generally does not have a lateral force binding each filament constituting the multifilament, and accordingly, when the multifilament is wound while using the conventional traverse guide, the filaments constituting the multifilament are biased in a direction in which the filaments are moved by the traverse guide, and thus it is impossible in practice to wind the multifilament in a state such that the filaments are dispersed over a broad width.

Therefore, an apparatus by which the multifilament is fed continuously while a traverse motion is applied thereto, and the multifilament is continuously wound in a state such that the filaments are dispersed in a thin flat shape with a broad width, has not been disclosed.

Further, a contacting roll, called a "roller bale" and having a slightly longer length than a width of a yarn package, is used in a conventional winder to obtain a more desirable shape of the yarn package. This contacting roll is in contact with the yarn package at all times during the winding the multifilament, and therefore, when this winder is used to wind a multifilament such as a carbon fiber or the like, more damage to the multifilament occurs due to friction between the multifilament and the contacting roll.

SUMMARY OF THE INVENTION

An object of the present invention is to provide an apparatus for continuously winding a multifilament in such a manner that the multifilament is continuously fed, a traverse movement is applied thereto and it is wound on a mandrel in a thin flat shape with a broad width under a condition such that damage to filaments constituting the multifilament is greatly reduced.

The object of the present invention is achieved by an apparatus for winding a multifilament in a flat shape with a broad width comprising a self-rotatable mandrel for winding the multifilament and a yarn guiding device arranged upstream of the mandrel, and feeding the multifilament while spread out to form a flat shape with a broad width to the mandrel, and applying a traverse movement to the multifilament.

The yarn guiding device is composed of a pair of rotatably supported guide rolls each having a generatrix arranged in parallel with the other in such a manner that a space through which the multifilament can pass is formed in a direction perpendicular to the traverse movement of the multifilament between the pair of rotatably supported guide rolls, a collecting means arranged downstream of the pair of guide roll and collecting the multifilament along the traverse direction of the multifilament, and a spreading means arranged downstream of the collecting means and spreading the multifilament along the traverse direction of the multifilament.

The mandrel can be moved in such a manner that a distance between the mandrel and the spreading means is increased in accordance with an increase of a diameter of a yarn package of the multifilament wound on the mandrel.

Preferably a roll having one end rotatably supported and an axis inclined in the traverse direction, and having a shape tapered toward a free end thereof and a concave curved face formed on a circumferential surface thereof, is used as the collecting means of the multifilament. When this roll is used as the collecting means, the collecting of the filaments i.e., plural single filaments, constituting the multifilament, can be effectively carried out and a multifilament undesirably wound on the roll is easily removed therefrom.

Further, preferably a curved face spreading means capable of deflecting an arrangement of the multifilament from a direction along the space of the pair of guide rolls to a desired direction, and of spreading the multifilament is arranged between the pair of guide rolls and the collecting means. The multifilament can be arranged on the collecting means by using the curved face spreading means.

It is preferable to use a sphere-like roll having a convex surface on at least a portion of a circumferential surface thereof, as the curved face spreading means, and further preferably, the sphere-like roll is arranged such that an axis of the sphere-like roll can be moved to both sides from a position just below the space of the pair of guide rolls.

Also, preferably a rotatable convex roll arranged in such a manner that a rotational axis of the convex roll becomes parallel to the traverse direction is used as the spreading means of the multifilament. Note, a rotatable concave roll arranged in such a manner that an axis of the concave roll becomes parallel to the traverse direction may be used as the multifilament collecting means.

DESCRIPTION OF THE PREFERRED EMBODIMENT

To facilitate understanding of the present invention, the essential technical concept of an apparatus for winding a multifilament in accordance with the present invention is described in detail with reference to the attached drawings.

Figure 1:
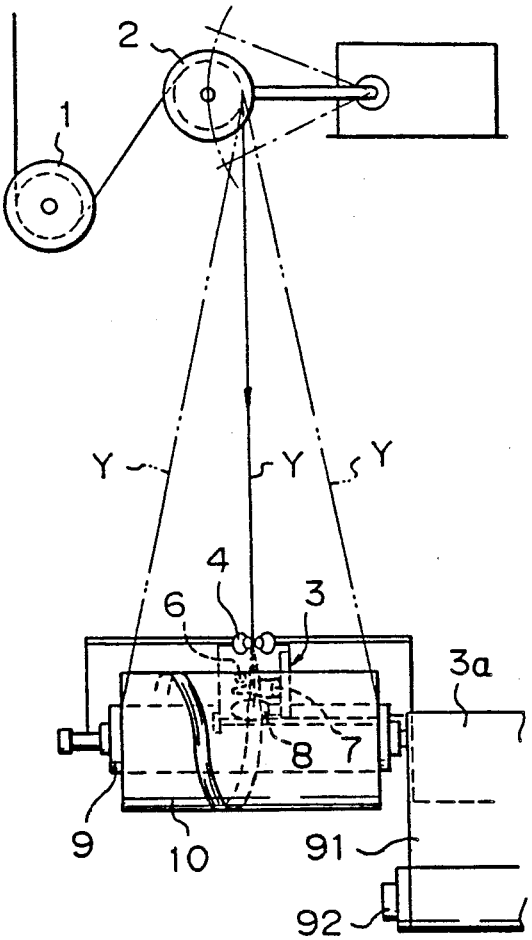
FIG. 1 is a front view of an embodiment of an apparatus for winding a multifilament in a flat shape with a broad width in accordance with the present invention.
Figure 2:
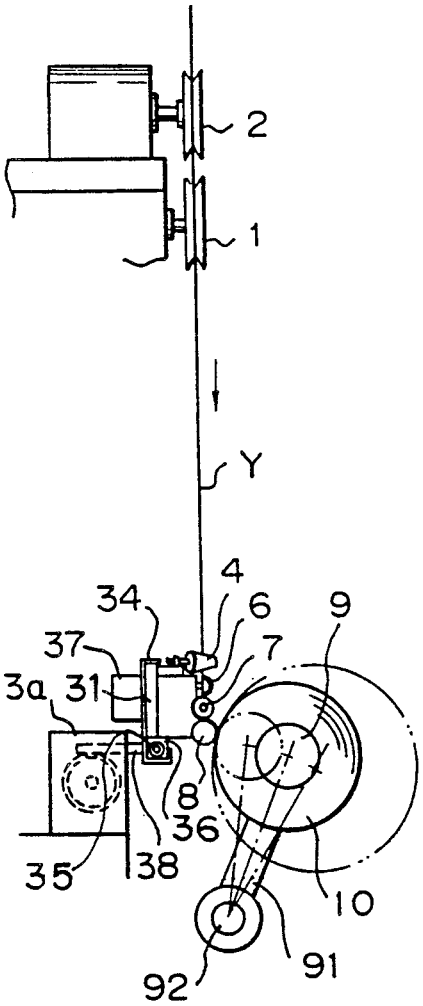
FIG. 2 is a side view of the apparatus illustrated in FIG. 1.

An embodiment of an apparatus for winding a multifilament in a flat shape with a broad width in accordance with the present invention is shown in FIGS. 1 and 2. As can be seen from FIGS. 1 and 2, a multifilament Y constituted with a plurality of filaments and fed from a spinning machine or the like is guided through a deflecting roll 1 and a dancer roll 2 to the apparatus in accordance with the present invention.

The apparatus in accordance with the present invention is comprised of an independently driven mandrel 9, a housing 3 capable of reciprocally moving along an axial direction of the mandrel 9 by a predetermined length, and a yarn guiding device provided in the housing 3.

An end of the mandrel 9 is rotatably supported by an end of an arm 91, and another end of the arm 91 is rotatably supported by a shaft 92. The mandrel 9 is rotated by a driving mechanism (not shown), and the multifilament Y fed through the yarn guiding device 4, 6, 7, and 8 is continuously wound to make a yarn package 10. The mandrel 9 is urged toward a roll 8, which is a spreading means arranged at a lower most position of the yarn guiding device to maintain contact between the yarn package 10 and the roll 8, and is moved away from the roll 8 in accordance with an increase of a diameter of the yarn package 10.

Figure 3:
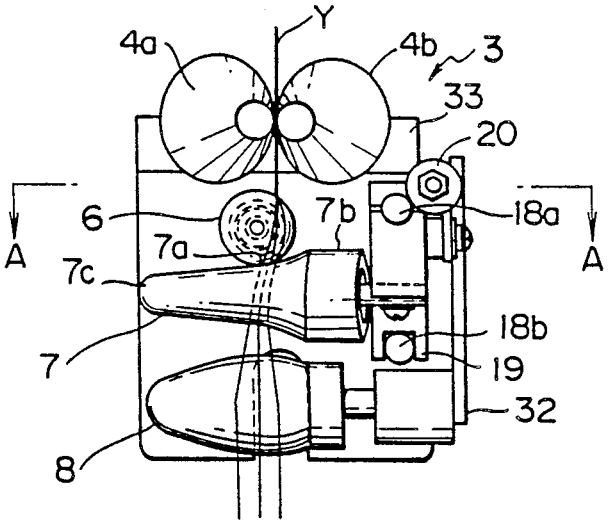
FIG. 3 is an enlarged front view of a yarn guiding device of the apparatus illustrated in FIG. 1.
Figure 4:
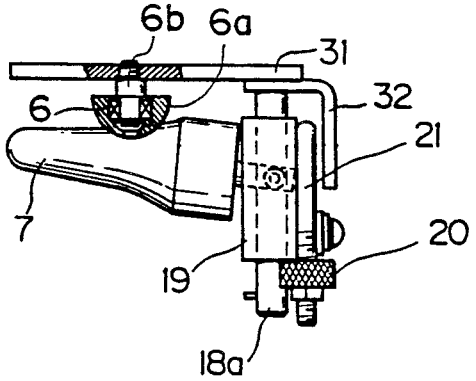
FIG. 4 is an enlarged plan view taken along a line 4—4 of FIG. 3.

FIGS. 3 and 4 show a detailed constitution of an embodiment of the yarn guiding device in accordance with the present invention. As can be seen from FIGS. 3 and 4, the housing 3 is comprised of an upper roll holder 33 supporting a pair of guide rolls 4*a* and 4*b*, a side roll holder 32 rotatably supporting a collecting means 7 and a spreading means 8 at each end thereof, and a bracket 31 supporting a curved face spreading means 6 and connecting the upper roll holder 33 and the side roll holder 32.

To reciprocally move the housing 3 in a direction parallel to an axis of the mandrel 9, a traverse driving mechanism 3*a* such as a scroll cam or the like is provided on a frame of the apparatus for winding the multifilament, and a guide member 34 for guiding the housing 3 is provided on a side face of a beam 37 extended from the frame. An end of a traverse bar 35 is connected to a lower end of the bracket 31, and a traverse guide block 38 extended from the traverse driving mechanism 3*a* is connected to another end of the traverse bar 35. When the traverse driving mechanism 3*a* is activated, the traverse bar 35 is moved reciprocally in a traverse direction, i.e., a direction parallel to the axis of the mandrel 9, and a slider 36 provided on a top end of the traverse bar 35 slides in the guide member 34 to apply a reciprocal movement to the housing 3.

A detailed constitution of a first embodiment of the yarn guiding device of the apparatus in accordance with the present invention will be described with reference FIGS. 3 to 5.

The yarn guiding device of the first embodiment is comprised of a pair of guide rolls 4*a* and 4*b*, a curved face spreading means 6, a collecting means 7, and a spreading means 8.

Figure 5:
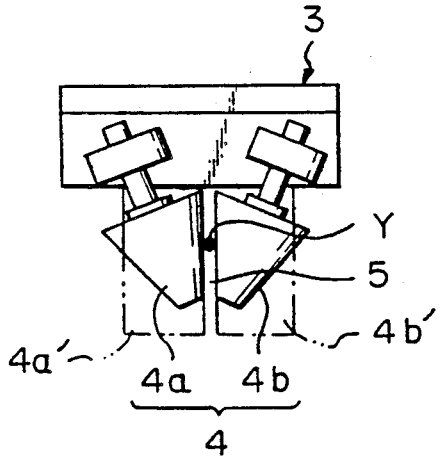
FIG. 5 is an enlarged plan view of a pair of guide rolls used in the apparatus illustrated in FIG. 1.

A pair of conical rolls 4*a* and 4*b* is used as the pair of guide rolls, and these conical rolls 4*a* and 4*b* are arranged in such a manner that a generatrix of each of the conical rolls 4*a* and 4*b* is parallel to the other, whereby a space 5 through which the multifilament Y can pass is formed, and the two generatrixs are arranged in a direction perpendicular to the traverse direction of the multifilament, as shown in FIG. 5.

The yarn Y, i.e., a multifilament Y, inserted in the space 5 has a tendency to spread in a lengthwise direction of the space 5, and therefore some filaments in the multifilament may drop out of the space 5. Nevertheless, because the conical rolls 4*a* and 4*b* are used as the pair of guide rolls 4, filaments in contact with surfaces of the conical rolls 4*a* and 4*b* are automatically moved toward the side having a large diameter of the conical rolls 4*a* and 4*b*, and accordingly, drop out of the filaments is prevented. Also, if a pair of parallel rolls 4*a*' and 4*b*' having a sufficient length, as shown by the chain lines in FIG. 5, is used, it is possible to prevent drop out of the filaments from the space 5.

A sphere-like roll 6 having a convex surface on at least a portion of a circumferential surface thereof is used as the curved face spreading means in this embodiment. As shown in FIG. 4, the sphere-like roll 6 is shown as a hemispherical roll having a convex surface 6*a* and rotatably supported by a shaft 6*b*. The shaft 6*b* is arranged in a direction parallel to the space of the pair of guide rolls 4, on the bracket 31.

When the shaft 6 of the hemispherical roll 6*b* is arranged on the bracket 31, preferably the shaft 6*b* is arranged on one side, spaced apart and just below the space of the pair of guide rolls 4. The transportation of filaments of the multifilament Y from the pair of guide rolls 4 to the collecting means 7 is made smoother by using the sphere-like roll 6 and arranging the sphere-like roll 6 as described above, and thus a yarn package having a superior quality can be obtained.

In this embodiment, a roll 7 having a constitution shown in FIGS. 3 and 4 is used as the collecting means. Namely, as shown in FIGS. 3 and 4, one end 7*b* of the roll 7 is rotatably supported, through a slider 19 and two guiding rods 18*a* and 18*b*, by a bracket 31, a circumferential surface of the roll 7 is tapered toward a free end 7*c* of the roll 7, and a portion 7*a* of the circumferential surface with which the multifilament coming from the sphere-like roll 6 is in contact has a concave shape. The axis of the roll 7 is inclined in the traverse direction, as can be clearly seen in FIG. 4.

The slider 19 is supported in a state such that it can be moved in a horizontal direction by the two guiding rods 18*a* and 18*b* each having one end connected to the bracket 31, and is urged toward a free end of the two guiding rods 18*a* and 18*b* by a spring (not shown). An adjusting nut 20 in contact with the one end of the slider 19 is provided, whereby a position of the slider 19 relating to the bracket 31 can be adjusted by rotating the adjusting nut 20 on a bolt 21 connected to the side roll holder 32.

The roll 7 is arranged such that an angle of the roll to the slider 19 can be adjusted on the slider 19. This angle may be determined in accordance with a curvature of the sphere-like roll 6 and a required degree of collecting the multifilament. Although a horizontal movement of the roll 7 operated by the slider 19 is not indispensable to the apparatus in accordance with the present invention, a yarn introducing operation of the apparatus can be facilitated by making the roll 7 slidable in the horizontal direction.

A convex roll 8 is used as the spreading means in this embodiment. This convex roll 8 has a convex curved surface on at least a middle portion 8*a* thereof and an axis of the convex roll 8 is arranged in the traverse direction. One end of the convex roll 8 is rotatably supported on a lower portion of the side roll holder 32.

The multifilament Y collected by the collecting means 7 can be spread by using the convex roll 8, and wound on the mandrel 9 having a surface in contact with the convex roll 8.

An operation of the apparatus having a yarn guiding device shown in FIGS. 1 to 5 will be described hereafter.

The multifilament Y inserted from a dancer roll 2 to the space 5 of the pair of conical rolls 4*a* and 4*b* is traversed in a direction parallel to the axis of the mandrel 9 by the reciprocal movement of the housing 3 including the yarn guiding device, and is spread in the space 5 having a lengthwise direction perpendicular to the traverse direction. Then the multifilament Y is advanced while bent through a front side of the sphere-like roll 6, and a back side of the roll 7 having a concave surface to a front side of the convex roll 8, and is wound on the mandrel 9. When the multifilament Y moves over each roll 6, 7 and 8, since each roll 6, 7 and 8 can be freely rotated, there is substantially no resistance to the spreading operation and collecting operation applied to each filament constituting the multifilament Y. Therefore the filaments can be spread by the convex surface of the sphere-like roll 6. Note some irregularity of the spreading operation is caused by the sphere-like roll 6, and accordingly the spread filaments are collected to form a flat shape having a predetermined width in a position corresponding to a center portion of the concave roll 8, by the concave surface of the roll 7, and the filaments of the multifilament Y are further spread to a predetermined width before winding the multifilament on the mandrel 9. The winding position of the multifilament Y on the mandrel 9 can be stabilized, and a winding operation by which a regular spread of the filaments of the multifilament can be obtained, is due to the use of the concave surface of the roll 7.

The tapered roll having one end supported is used in this embodiment, and accordingly, the removal of an undesirable winding of the multifilament on the tapered roll 7 is easy.

The axis of the tapered roll 7 is inclined in the traverse direction, to ensure the collecting operation of the filaments on the tapered roll 7 as described herebefore. But the tapered roll 7 can be arranged in a manner such that the axis of the tapered roll 7 is parallel to the traverse direction by suitably determining a shape of the circumferential surface of the tapered roll 7, particularly a shape and/or a position of the concave portion thereof.

Figure 6:
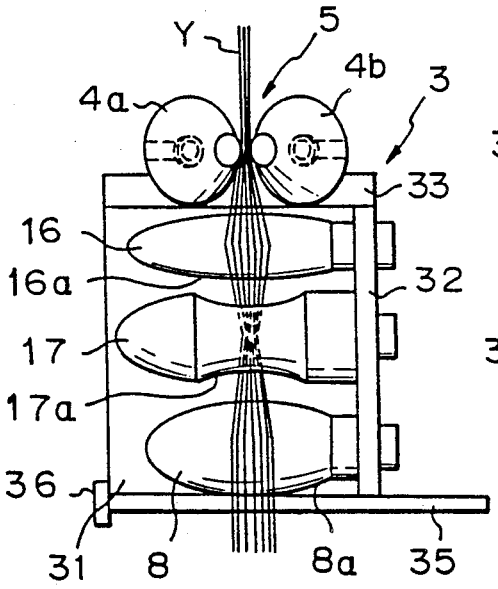
FIG. 6 is an enlarged front view of a yarn guiding device in another embodiment of an apparatus in accordance with the present invention.
Figure 7:
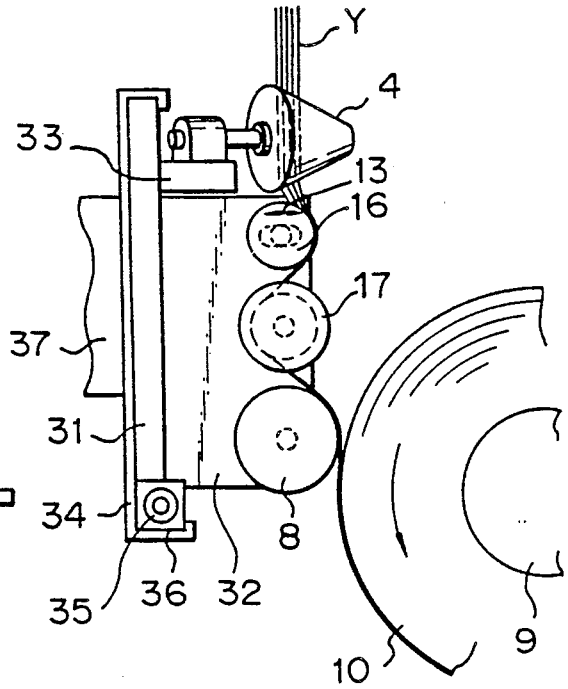
FIG. 7 is an enlarged side view illustrating a relationship between the yarn guiding device illustrated in FIG. 6 and a yarn package.

Another embodiment of a yarn guiding device of the apparatus in accordance with the present invention will be described with reference to FIGS. 6 and 7.

In this embodiment, a roll 16 having a convex circumferential surface 16*a* is used instead of the sphere roll 6 used in the embodiment shown in FIGS. 3 and 4, and a roll 17 having a concave portion 17*a* on a circumferential surface thereof is used instead of the tapered roll 7 used in the embodiment shown in FIGS. 3 and 4. Although a problem arises in that removal of an undesirable winding of the multifilament on the roll 17 becomes more difficult, the apparatus having this yarn guiding device can be also used for winding the multifilament in a flat shape with a broad width.

It is possible to adjust the spread width of the multifilament Y, caused by the sphere-like roll 6, by changing a distance of the sphere-like roll 6 from a position just below the space of the conical rolls 4*a* and 4*b* in the yarn guiding device shown in FIGS. 3 and 4.

When the convex roll 16 is used, preferably the convex roll 16 is displacable in a direction parallel to the space 5. Namely, it is possible to adjust the spread width of the multifilament Y by displacing the convex roll 16 toward or away from the pair of conical rolls 4*a* and 4*b*.

In the above description of the embodiments, the sphere-like roll 6 or the convex roll 16 is used as an element of the yarn guiding device, but even if the sphere-like roll 6 or the convex roll 16 is not used, the multifilament Y passed through the pair of conical rolls 4*a*, 4*b* may be arranged in a slightly spread state on a surface of the collecting roll 7 or 17. Accordingly, the use of the sphere-like roll 6 or the convex roll 16 is not indispensable to the present invention.

Sequential changes of the arrangement of filaments of the multifilament advanced from the pair of conical rolls 4*a* and 4*b* to the sphere-like roll 6 or the convex roll 17 will be described with reference to FIGS. 8 and 9.

Figure 8:
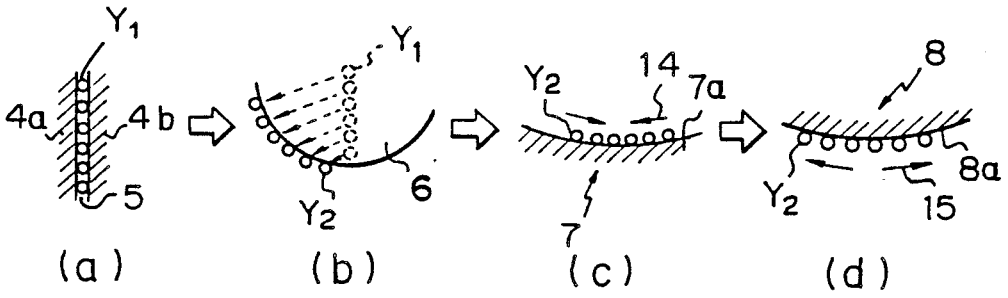
FIG. 8 is a simulation view illustrating sequential changes of arrangements of filaments in the multifilament when the multifilament is wound by the apparatus having the yarn guiding device illustrated in FIG. 3; and, FIG. 9 is a simulation view illustrating sequential changes of arrangements of filaments in the multifilament when the multifilament is wound by the apparatus having the yarn guiding device illustrated in FIG. 6.

FIG. 8 shows the sequential changes of the arrangement of filaments when using the sphere-like roll 6. A plurality of filaments $Y_1$ of the multifilament aligned in the space 5 of the pair of conical roll 4*a* and 4*b*, as shown in FIG. 8(*a*), is regularly transferred on a surface of the sphere-like roll 6, as shown as by the filaments $Y_2$ in FIG. 8(*b*). The filaments $Y_2$ are collected in the direction 14 on the concave surface 7*a* of the tapered roll 7, and then are spread regularly in the direction 15 on the convex surface 8*a* of the spreading roll 8, without interlacement of the filaments.

Figure 9:
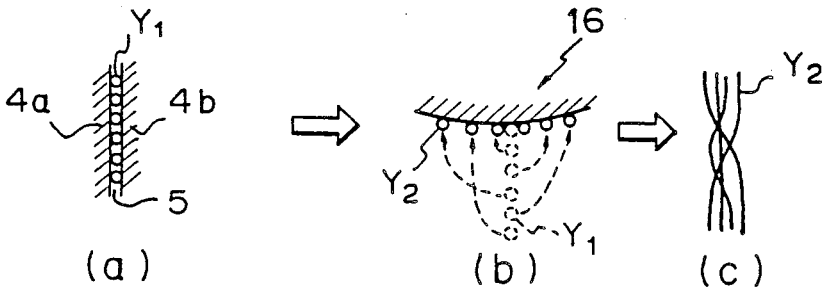

FIG. 9 shows the sequential changes of the arrangement of filaments when using the convex roll 16. In this case, a plurality of filaments $Y_1$ aligned in the space 5 as shown in FIG. 9(*a*) are often irregularly transferred onto a surface of the convex roll 16, as shown in FIG. 9(*b*), resulting in an interlacement of the filaments $Y_2$ as shown in FIG. 9(*c*). The difference between the above two cases is that the filaments $Y_1$ can be sequentially transferred by being guided along a sphere-like surface of the sphere-like roll in the former case, but the filaments may be independently transferred from the space 5 on the surface of the convex roll 16 in the latter case.

It is possible to wind the multifilament in a uniformly spread state on the mandrel, by using the apparatus for winding the multifilament in accordance with the present invention, and a fiber structure having superior properties can be obtained from the multifilament wound by the apparatus in accordance with the present invention.

The filaments are not subjected to friction by members constituting the yarn guiding device, because all of those members can be freely rotated. Therefore, damage to the filaments is less compared with that in a conventional winder used to wind a carbon fiber or the like.

We claim:

1. An apparatus for winding a multifilament in a flat shape with a broad width, said apparatus comprising an independently driven mandrel for winding the multifilament and a yarn guiding device arranged upstream from the mandrel for feeding the multifilament spread into a flat shape with a borad width to the mandrel while applying a transverse movement to the multifilament;

wherein said yarn guiding device comprises a pair of rotatably supported guide rolls each having a generatrix arranged in parallel to the other in such a manner that a space through which the multifilament can pass is formed in a direction perpendicular to the traverse direction of the multifilament between the pair of rotatably guide rolls, a collecting means arranged downstream of the pair of guide rolls for collecting the multifilament along the traverse direction of the multifilament, a spreading means arranged downstream of the collecting means for spreading the multifilament along the traverse direction of the multifilament, and means for movably mounting said mandrel whereby a distance between the mandrel and the spreading means is increased in accordance with an increase of a diameter of a yarn package of the multifilament wound on the mandrel.

2. An apparatus according to claim 1, wherein said yarn guide device further comprises a curved face spreading means arranged between the pair of guide rolls and the collecting means for detecting the multifilament from a direction along the space of the pair of guide rolls to a direction parallel to the transverse direction and spreads the multifilament.

3. An apparatus according to claim 1, wherein said collecting means is a roll having one end rotatably supported, and an axis inclined in the traverse direction, having a shape tapered toward a free end thereof and with a concave curved face formed on a circumferential surface thereof.

4. An apparatus according to claim 1, wherein said collecting means is a rotatable concave roll arranged in such a manner that an axis of the concave roll is parallel to the traverse direction.

5. An apparatus according to claim 1, wherein said spreading means is a rotatable convex roll arranged in such a manner that an axis of the convex roll is parallel to the traverse direction.

6. An apparatus according to claim 2, wherein said curved face spreading means is a sphere-like roll having a convex surface on at least a portion of a circumferential surface thereof, and said sphere-like roll is rotatably supported in such a manner that a rotational axis of said sphere-like roll is in parallel to the space of the pair of guide rolls.

7. An apparatus according to claim 6, wherein said axis of the sphere-like roll is arranged on one of either sides apart from and just below the space of the pair of guide rolls.

* * * * *